US010961743B2

(12) United States Patent
Crandall et al.

(10) Patent No.: US 10,961,743 B2
(45) Date of Patent: Mar. 30, 2021

(54) FENCE BRACE SYSTEM ADAPTED FOR USE WITH CORNER FENCE POST ARRANGEMENTS

(71) Applicants: Fonda Crandall, Reno, NV (US); Joseph Crandall, Reno, NV (US)

(72) Inventors: Fonda Crandall, Reno, NV (US); Joseph Crandall, Reno, NV (US)

( * ) Notice: Subject to any disclaimer, the term of this patent is extended or adjusted under 35 U.S.C. 154(b) by 99 days.

(21) Appl. No.: 16/517,582

(22) Filed: Jul. 20, 2019

(65) Prior Publication Data

US 2019/0338556 A1 Nov. 7, 2019

Related U.S. Application Data

(63) Continuation-in-part of application No. 14/863,793, filed on Sep. 24, 2015, now Pat. No. 10,030,408, and a continuation-in-part of application No. 15/856,710, filed on Dec. 28, 2017, now Pat. No. 10,731,378.

(51) Int. Cl.
*E04H 17/14* (2006.01)

(52) U.S. Cl.
CPC ..... *E04H 17/1421* (2013.01); *E04H 17/1434* (2013.01); *E04H 2017/1452* (2013.01); *E04H 2017/1473* (2013.01)

(58) Field of Classification Search
CPC ..... E04H 17/1413; E04H 17/1417; E04H 17/1421; E04H 17/1426; E04H 17/143; E04H 17/1434; E04H 2017/1447; E04H 2017/1452; E04H 2017/1473
See application file for complete search history.

(56) References Cited

U.S. PATENT DOCUMENTS

| | | | | |
|---|---|---|---|---|
| 2,608,386 A * | 8/1952 | Hart | E04H 17/1434 | 256/65.06 |
| 4,526,348 A * | 7/1985 | Cammack | F16B 7/0486 | 256/65.06 |
| 5,186,571 A * | 2/1993 | Hentzschel | F16B 9/052 | 403/231 |
| 6,290,214 B1 * | 9/2001 | DeSouza | E04H 17/1413 | 256/55 |
| 2007/0034846 A1 * | 2/2007 | Ratanasiriwilai | E04H 17/1413 | 256/65.01 |

FOREIGN PATENT DOCUMENTS

| | | | | |
|---|---|---|---|---|
| GB | 275371 | * | 8/1927 | E04H 17/1413 |
| GB | 325612 | * | 2/1930 | E04H 17/1413 |
| GB | 677092 | * | 8/1952 | E04H 17/1413 |

* cited by examiner

*Primary Examiner* — Michael P Ferguson

(57) ABSTRACT

The present invention comprises a brace adapted to secure one or more fence rails to a fence post. The present invention brace may optionally be installed onto an existing fence or on a new fence. The invention includes a fence post brace member adapted to connect to two or more sides of a fence post and a pair of fence rail flanges for receiving one or more fence rails either in a vertical orientation or a horizontal orientation. The fence rail flanges may form one or more picket fastening slots for use in affixing a picket to the fence rails. The fence post brace system may be adapted for use with corner fence post arrangements.

7 Claims, 7 Drawing Sheets

FENCE BRACE SYSTEM ADAPTED FOR USE WITH CORNER FENCE POST ARRANGEMENTS

CROSS-REFERENCES TO RELATED APPLICATIONS

This non-provisional utility application is a continuation-in-part (CIP) application of the pending U.S. application Ser. No. 14/863,793 titled "Fence Brace System" and originally filed Sep. 24, 2015, and of the pending U.S. application Ser. No. 15/856,710 titled "Fence Brace System" and originally filed Dec. 28, 2017 (pending U.S. application Ser. No. 15/856,710 is a divisional application of pending U.S. application Ser. No. 14/863,793), which are hereby incorporated in their entirety by reference.

BRIEF DESCRIPTION OF THE INVENTION

The present invention relates to the field of fences. More particularly, the present invention relates to a system for providing structural support for fences including for fences having one or more corner fence post arrangements.

The present invention provides strength for building a new fence or repairing an existing fence. The fence would not need to be removed or modified to install the herein disclosed brace. Installation would be simple. The brace could be mass produced at low cost. The color and style of the brace could be easily adapted to match aesthetically with the fence and the surrounding area. The brace itself may be painted, stained, powder coated, colored, or made with a colored metal. The brace may also be built into a new fence. The present invention optionally includes embodiments adapted for fences with rectanguloid rails or for rectanguloid fence posts. The present invention may be optionally optimized for a fence with cylindrical fence posts. The present invention may also include an embodiment adapted to secure the corner pieces of the fence. In an additional optional embodiment, the present invention is adapted to secure a fence on a slope. The brace may be made of strong weather-resistant material such as steel, stainless steel, galvanized steel, aluminum, plastic, graphite, wood, or any composite material(s).

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND OF THE INVENTION

Fence and fence structure are subject to damage due to high winds, torrential rains, heavy snowfall, vehicular accidents, termites, vandalism, earthquakes and falling trees and branches. The most common of these causes is high winds. Wind damages fences all around the world every year. Fences made of wood are especially susceptible to wind damage because wood is weakened by prolonged exposure to rain, snow, wind, and other elements. Despite the potential for damage, wood is still by far the most common residential fencing material in the United States. In 2007 alone, Americans put up 59,000 miles of wood fencing, enough to circle the globe twice. Wood is inexpensive and lightweight, and a wood fence can easily be shaped to give properties character and individuality. There are many styles, including linear post-and-rail and crisscrossing lattice, as well as myriad picket patterns and post-cap designs. And the wood may be painted or stained to match almost any landscape.

Fences could be built much stronger through the use of heavy materials such as steel and sturdy construction. However, this might drive the costs of the fence up above what is acceptable. As well, there are the aesthetic considerations discussed above. Also, it is unlikely that a property owner would replace an existing fence merely because of the possibility that it could be damaged by the elements.

There is an unmet need, therefore, for an inexpensive way to provide a fence with additional structural support. The need is especially great with respect to existing fences and with respect to wooden fences.

DETAILED DESCRIPTION OF THE INVENTION

Figure 2:
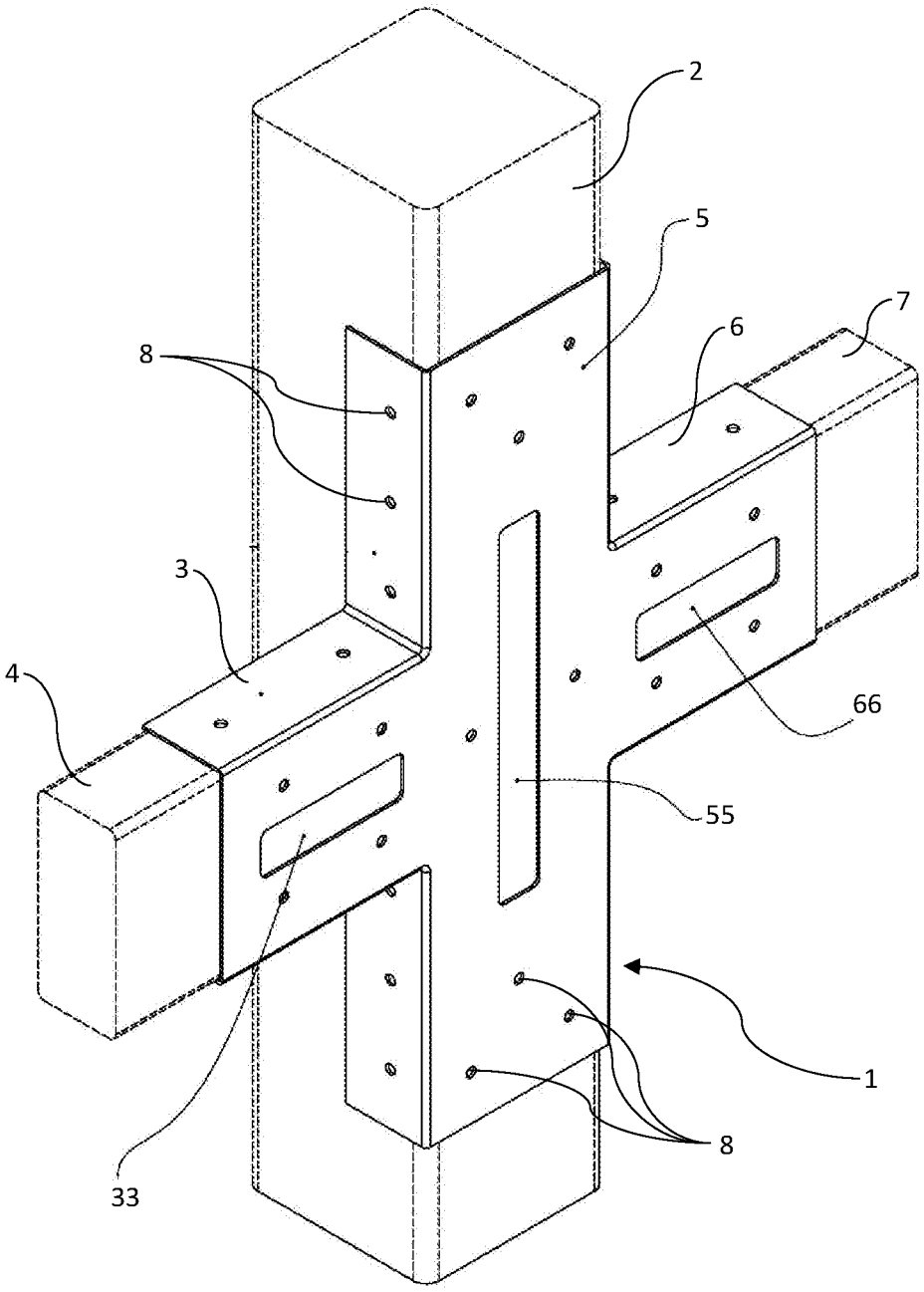
FIG. 2 illustrates an isometric view of a preferred embodiment of a fence brace, in accordance with the present invention.

In a preferred embodiment as illustrated in FIG. 2, the present invention comprises fence brace 1 for securing at least one fence rail 4 to fence post 2 including first fence rail brace member 3 adapted to connect to two or more sides of first fence rail 4. First fence rail brace member 3 may be fused to a first side of fence post brace member 5 wherein fence post brace member 5 is adapted to connect to two or more sides of fence post 2. The fence rail may be rectanguloid. As used herein, the term "rectanguloid" means a solid (3-dimensional) object which has six faces that are rectangles. It has the same cross-section along a length. As used herein, "rectanguloid" is the same as a rectangular prism. A rectanguloid may be though of as a 3-dimensional version of a rectangle or a square. The herein disclosed fence brace system may further include second fence rail brace member 6 fused to a second side of fence post brace member 5, wherein second fence rail brace member 6 is adapted to connect to two or more sides of second fence rail 7.

Fence brace 1 may include plurality of holes 8 thereby allowing fence post brace member 5 to be securely fastened to fence post 2 and thereby allowing first fence rail brace member 3 to be securely fastened to first fence rail 4 and second fence rail brace member 7 to be securely fastened to second fence rail 7. The plurality of holes may be referred to as screw-holes, nail holes, bolt holes, or other fastener holes. The plurality of holes may each receive a screw, a nail, a bolt, or an alternative type of fastener for securely connecting fence brace 1 to the fence post and/or the fence rail(s). The various figures illustrate the plurality of holes positioned in exemplary locations; those skilled in the art will recognize that the plurality of holes may be formed in various locations on the fence brace to provide the intended benefit of allowing secure attachment of the fence brace to the fence (the fence post and the fence rails).

Fence brace 1 may be formed of a strong weather-resistant material such as selected from the group consisting of steel, stainless steel, galvanized steel, aluminum, plastic, graphite, wood, or any composite material(s).

An embodiment of the present invention may further include one or more picket fastening slots for allowing one or more pickets (or boards) to be attached to the fence. For example, and as illustrated in FIG. 2 as a preferred embodiment, fence post brace member 5 forms vertical picket fastening slot 55, first fence rail brace member 3 forms first horizontal picket fastening slot 33, and second fence rail brace member 6 forms second horizontal picket fastening slot 66. This embodiment allows for attachment of a picket to fence post 2 through vertical picket fastening slot 55, attachment of a picket to first fence rail 4 through first horizontal picket fastening slot 33, and/or attachment of a picket to second fence rail 7 through second horizontal picket fastening slot 66. After fastening one or more pickets through the respective picket fastening slot, the herein disclosed fence brace is positioned in between the fence and the picket.

Figure 3:
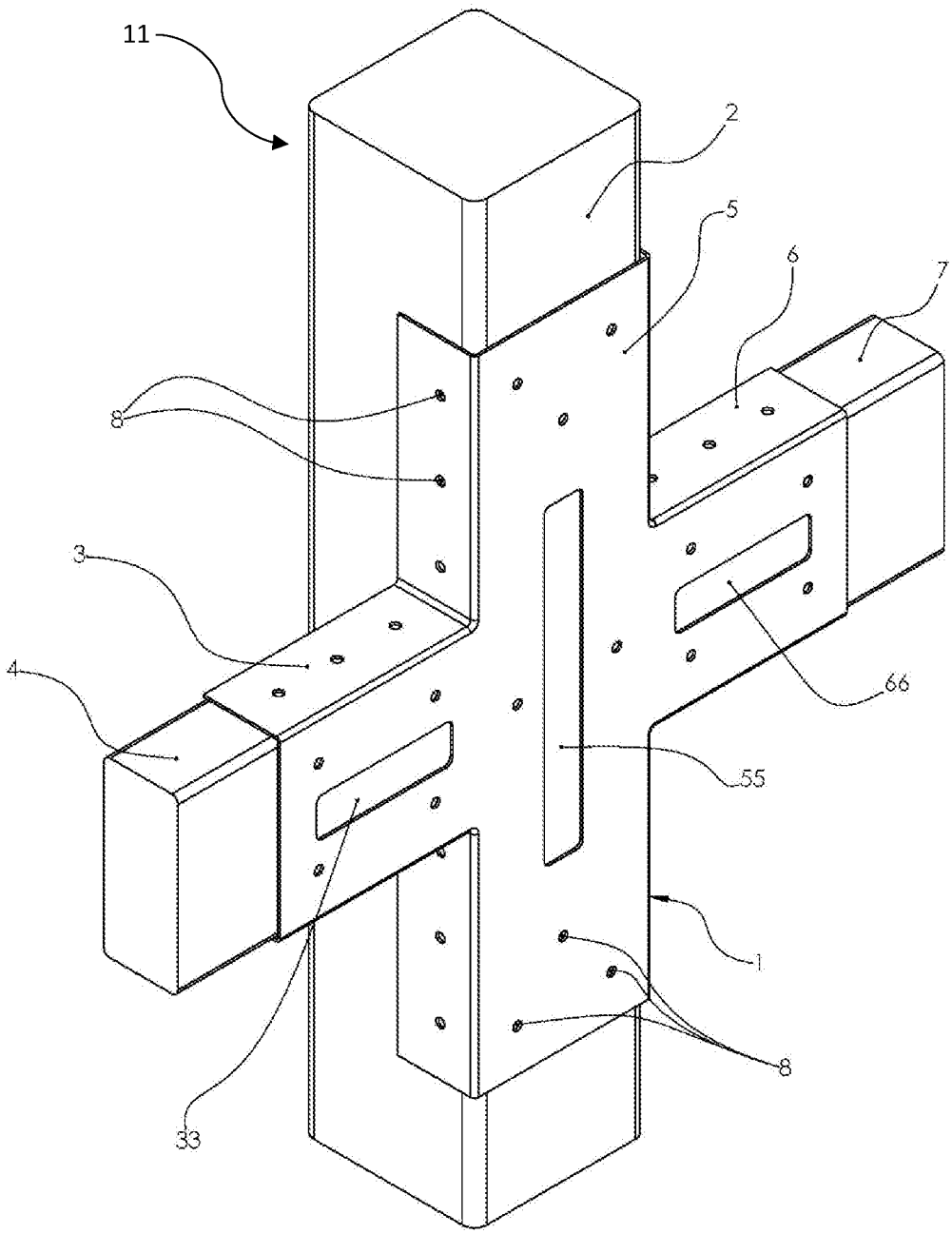
FIG. 3 illustrates an isometric view of a preferred embodiment of a fence assembly including a fence brace, a fence post, and a plurality of linearly disposed fence rails in accordance with the present invention.

Referring to FIG. 3, an embodiment of a fence brace assembly is illustrating comprising fence brace 1 attached to fence 11. Fence brace 1 includes fence post brace member 5 attached to fence post 2 and forming vertical picket fastening slot 55, first fence rail brace member 3 attached to first fence rail 4 and forming first horizontal picket fastening slot 33, and second fence brace member 6 attached to second fence rail 7 and forming second horizontal picket fastening slot 66.

Throughout this specification the fence brace system is mostly described as including a fence post brace member, a first fence rail brace member, and a second fence rail brace member. But for the present invention, fence post brace member 5 may alternatively be referred to as a pair of opposing upper and lower fence post flanges, each of the fence post flanges comprising a planer central wall and a pair of rearward-protruding side walls extending along opposing vertical longitudinally-extending edges of the central wall, the sidewalls of the upper fence post flange being vertically-aligned with the sidewalls of the lower fence post flange to define a pair of aligned channels for receiving the fence rail(s) therein. First fence rail brace member 3 and second fence rail brace member 6 may alternatively be referred to as a pair of opposing left and right fence rail flanges, each of the fence rail flanges comprising a planar central wall and a pair of rearward-protruding side walls extending along opposing horizontal longitudinally-extending edges of the central wall, the sidewalls of the left fence rail flange being horizontally-aligned with the sidewalls of the right fence rail flange to define a pair of aligned channels for receiving the fence rails therein.

Figure 1:
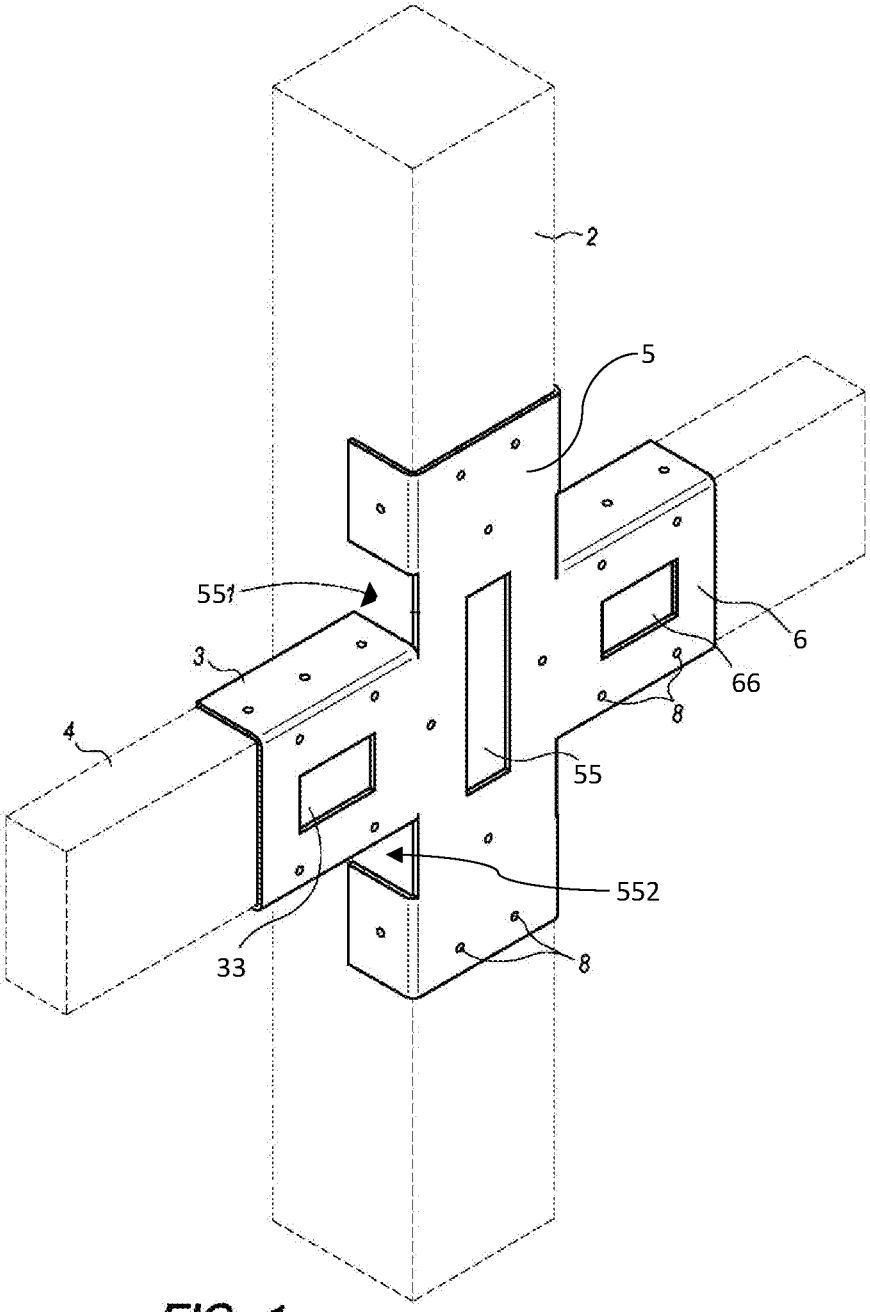
FIG. 1 illustrates an isometric view of an embodiment of a fence brace, wherein one or more cutouts are formed by the fence brace, in accordance with the present invention.

Referring to FIG. 1, an alternative embodiment of the herein disclosed fence brace system is illustrated wherein the rearward-protruding side walls of the opposing upper and lower fence post flanges do not extend all the way to the first and second fence rails. In this embodiment illustrated in FIG. 1, an upper flange cutout 551 is formed on each side of the upper flange and a lower flange cutout 552 is formed on each side of the lower flange. The embodiment illustrated in FIG. 2 differs in that the pair of rearward-protruding side walls extend fully towards first fence rail brace member and the second fence rail brace member so that the entire edge of the fence post (or a larger portion of the edge of the fence post) is covered by the rearward-protruding side walls.

Figure 4:
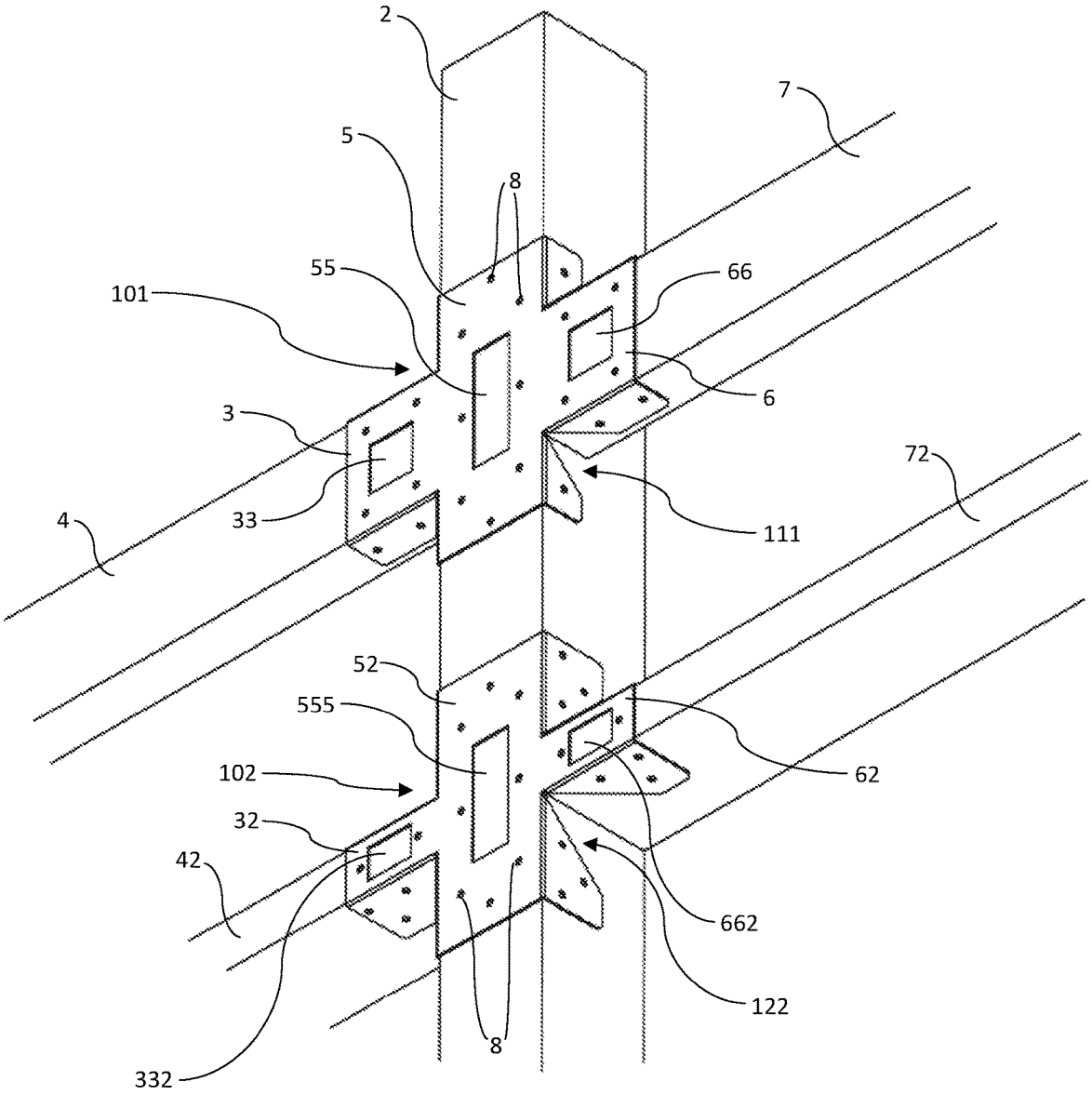
FIG. 4 illustrates an isometric view of two alternative embodiments of a fence assembly including a fence brace, a fence post, and a plurality of linearly disposed fence rails in accordance with the present invention, wherein the fence brace includes one or more angled or slanted edges formed by the rearward-protruding sidewalls.
Figure 5:
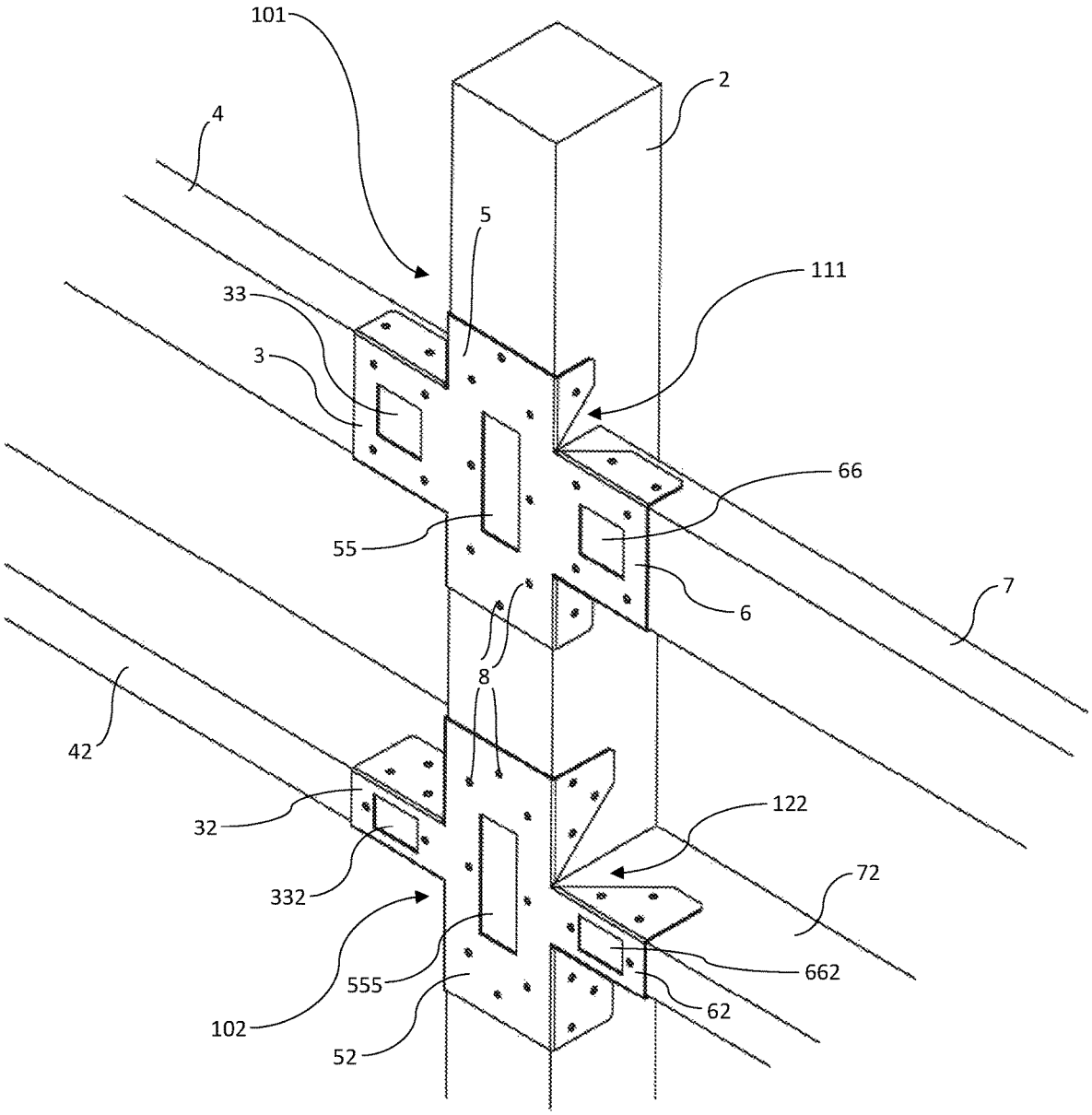
FIG. 5 illustrates an isometric view, from an alternative viewing angle, of two alternative embodiments of a fence assembly including a fence brace, a fence post, and a plurality of linearly disposed fence rails in accordance with the present invention, wherein the fence brace includes one or more angled or slanted edges formed by the rearward-protruding sidewalls.

Referring to FIG. 4 and FIG. 5, additional alternative embodiments of the herein disclosed fence brace system are shown that differ from the embodiment depicted in FIG. 1 by having one or more angled or slanted edges formed by the rearward-protruding sidewalls. In these alternative embodiments, one or more v-shaped cutouts may be formed by the rearward-protruding sidewalls.

Fence brace member 101 is adapted for use with first vertically oriented fence rail 4 and second vertically oriented fence rail 7. Fence rail 4 and fence rail 7 are referred to as vertically oriented because the respective fence rails are positioned so that they are taller than they are wide. Fence brace member 101 may include first fence rail brace member 3 forming first horizontal picket fastener slot 33, second fence rail brace member 6 forming second horizontal picket fastener slot 66, fence post brace member 5 forming vertical pocket fastener slot 55, one or more fastener holes 8, and may form one or more v-shaped cutout 111. V-shaped cutout 111 may be formed at one or more corners of fence brace member 101; in a preferred embodiment, v-shaped cutout 111 is formed at each of the four corners of fence brace member 101.

Fence brace member 102 is adapted for use with first horizontally oriented fence rail 42 and second horizontally oriented fence rail 72. Fence rail 42 and fence rail 72 are referred to as horizontally oriented because the respective fence rails are positioned so that they are wider than they are tall. Fence brace member 102 may include first fence rail brace member 32 forming first horizontal picket fastener slot 332, second fence rail brace member 62 forming second horizontal picket fastener slot 662, fence post brace member 52 forming vertical pocket fastener slot 555, one or more fastener holes 8, and may form one or more v-shaped cutout 122. V-shaped cutout 122 may be formed at one or more corners of fence brace member 102; in a preferred embodiment, v-shaped cutout 122 is formed at each of the four corners of fence brace member 102.

Figure 6:
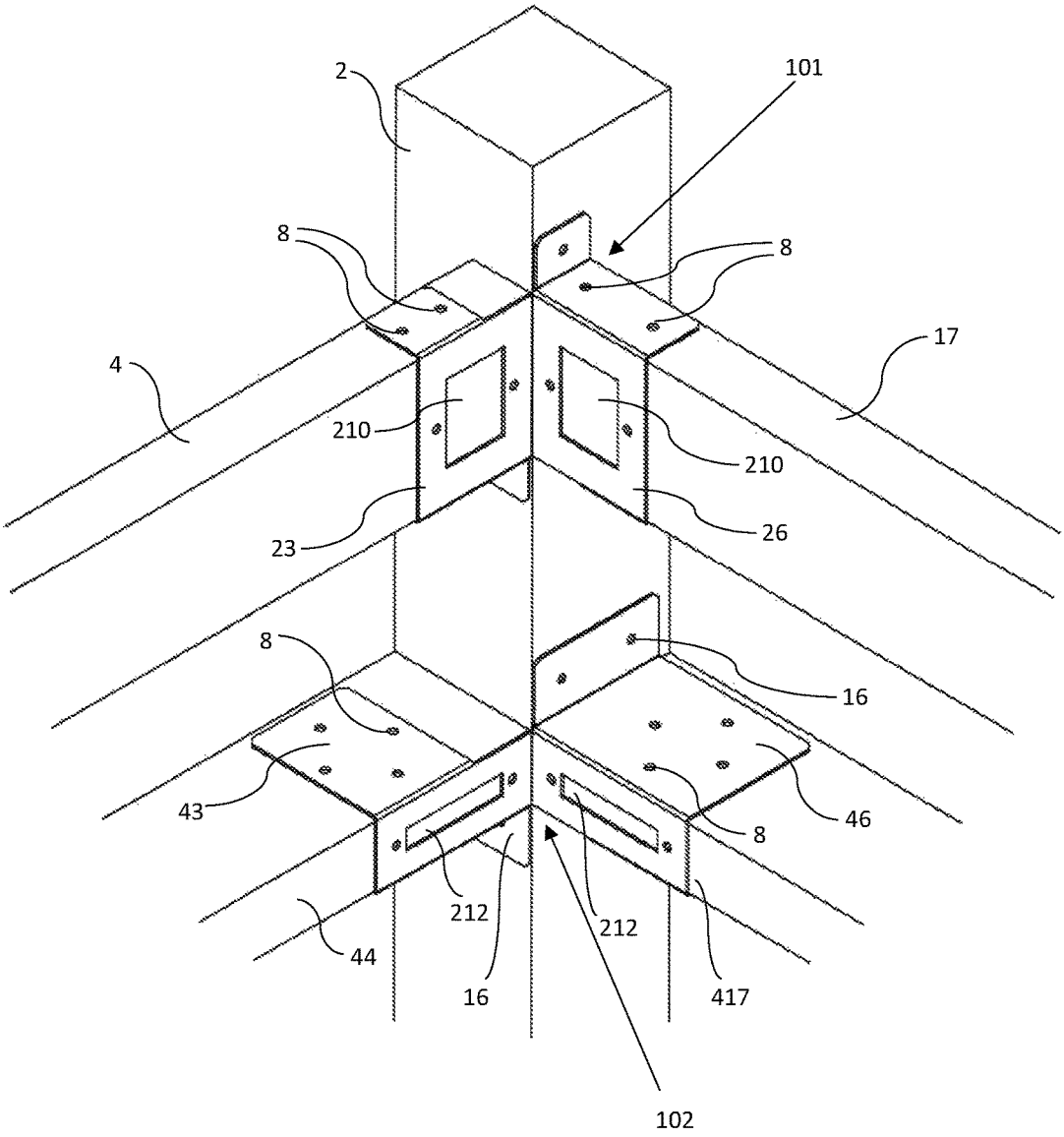
FIG. 6 illustrates an isometric view of two alternative embodiments of a fence assembly adapted for use to support a corner connection between a rectangular fence post and one or more rectangular fence rails, in accordance with the present invention.
Figure 7:
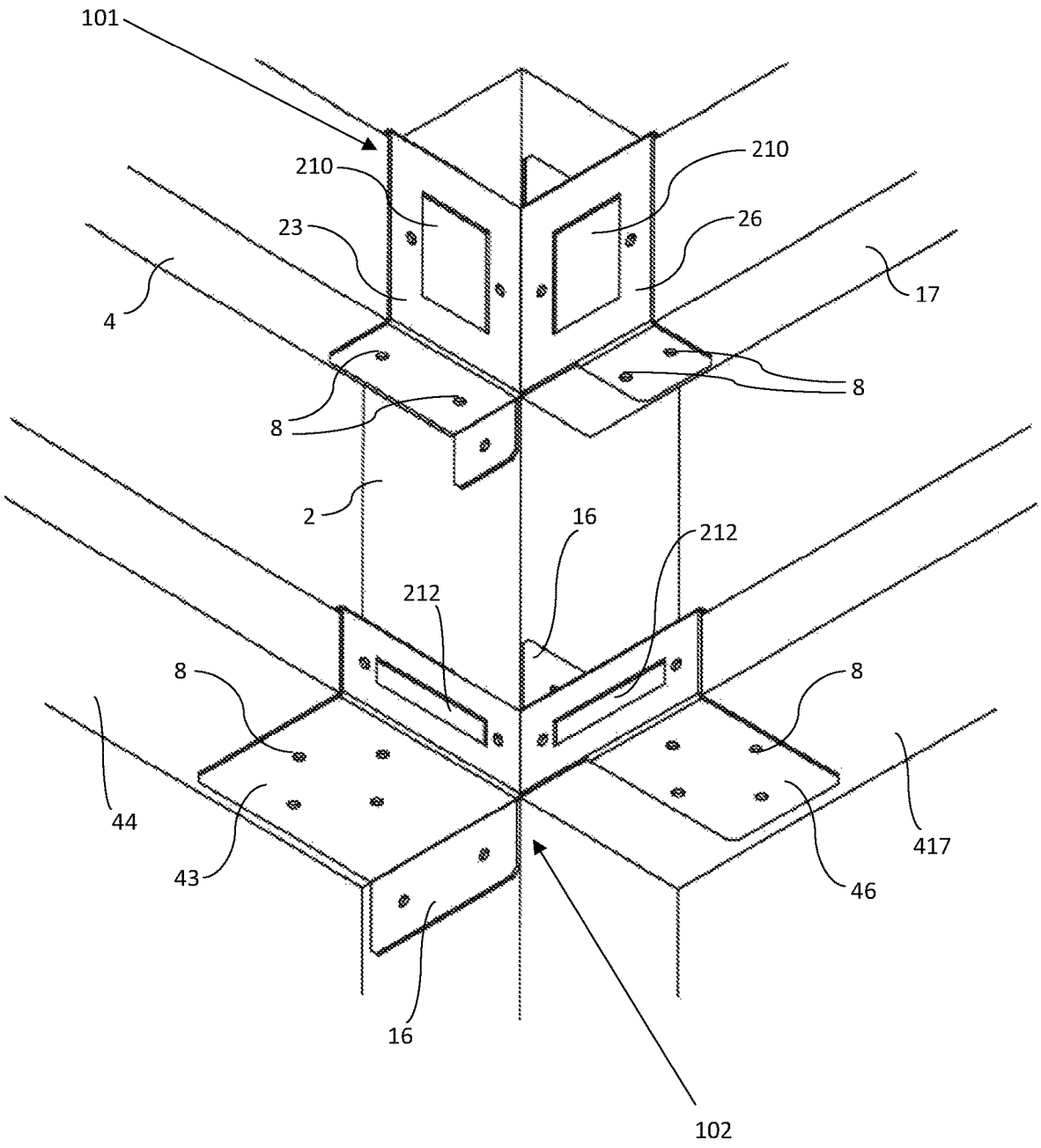
FIG. 7 illustrates an alternate isometric view of the two alternative embodiments depicted in FIG. 6 of a fence assembly adapted for use to support a corner connection between a rectangular fence post and one or more rectangular fence rails, in accordance with the present invention.

Referring to FIG. 6 and FIG. 7, two alternative embodiments of the herein disclosed fence assembly are shown that are adapted for use to support a corner connection between rectangular fence post 2 and one or more rectangular fence rails. The first alternative embodiment, having fence brace member 101, is shown at the top of FIG. 6 and is used to connect one or more fence rails having vertical orientation; in other words, fence rail 4 and fence rail 17 are oriented so that the fence rail is taller than it is wide. The second alternative embodiment, having fence brace member 102, is shown at the bottom of FIG. 6 and is used to connect one or more fence rails having a horizontal orientation; in other words, fence rail 44 and fence rail 417 are oriented so that the fence rail is wider than it is tall.

In the embodiment having fence brace member 101, a fence assembly comprises fence post 2 having a rectangular cross-section, first fence rail 4 having a rectangular cross-section, second fence rail 17 having a rectangular cross-section, and fence post brace member 101. Fence brace member 101 is intended to be utilized at a corner fence arrangement, and so it is intended to be used in situations where it is desired to attach first fence rail 4 to fence post 2 at a right angle (or another appropriate angle such as an acute angle or an obtuse angle) from second fence rail 17; second fence rail 17 is also attached to fence post 2.

Fence post brace member 101 includes left fence rail flange 23 and right rail flange 26. Each fence rail flange may include, for example, a planar central wall and a pair of rearward-protruding side walls extending along opposing horizontal latitudinally-extending edges of the central wall. The sidewalls of fence rail flange 23 define a first channel for receiving first fence rail 4. The sidewalls of fence rail flange 26 define a second channel for receiving second fence rail 17. A plurality of holes 8 may be formed or disposed throughout one or more portions of fence brace member 101, wherein plurality of holes 8 are for receiving one or more fasteners to secure the fence rail therein.

In certain embodiments, fence post brace member 101 may include at least one picket fastening slot 210 for receiving a fastener therethrough to affix a picket to fence rail 4 and/or to fence rail 17 with fence brace post member 101 therebetween. The fastener may be any type of fastener capable of attaching fence post brace member 101 to fence post 2 and/or fence rail 4 and/or fence rail 17; in an ideal embodiment, the fastener is a screw. Left fence rail flange 23 may form picket fastener slot 210 and right fence rail flange 23 may also a picket fastener slot 210. Picket fastener slot 210 may be formed in either rail flange (rail flange 23 or rail flange 26) or both rail flanges 23 and 26, and all such arrangements are intended to be included herein.

Fence post brace member 101 may include at least one perpendicularly fused flap forming one or more fastener holes and disposed to connect fence post brace member 101 to fence post 2 by receiving one or more fasteners, such as a screw for example, through the one or more fastener holes.

For fence post brace member 101, the sidewalls of left fence rail flange 23 may extend rearwardly along a portion of the planar central wall to form a cutout exposing a portion of first fence rail 4 adjacent to fence post 2. In other words, in certain embodiments the rearward protruding sidewalls of left fence rail flange 23 do not extend all the way to fence post 2, but instead extend along only a portion (or subset or fraction) of first fence rail 4 so that a cutout is formed adjacent to fence post 2.

A second alternative embodiment is also depicted in FIG. 6 and FIG. 7 having fence post member 102 adapted for use with one or more fence rails having a horizontal orientation. The second alternative embodiment is a fence assembly comprising fence post 2 having a rectangular cross-section, first fence rail 44 that is horizontally oriented and has a rectangular cross-section, second fence rail 417 that is horizontally oriented and has a rectangular cross-section, and fence post brace member 102. Fence brace member 102 is intended to be utilized at a corner fence arrangement wherein fence rail 44 and/or fence rail 417 are attached in a horizontal orientation, and so it is intended to be used in situations where it is desired to attach first fence rail 44 to fence post 2 at a right angle (or another appropriate angle, such as an acute or an obtuse angle) from second fence rail 417; second fence rail 417 is also attached to fence post 2.

Fence post brace member 102 includes left fence rail flange 43 and right rail flange 46. Each fence rail flange may include, for example, a planar central wall and a pair of rearward-protruding side walls extending along opposing horizontal latitudinally-extending edges of the central wall. The sidewalls of fence rail flange 43 define a first channel for receiving first fence rail 44 in a horizontal orientation. The sidewalls of fence rail flange 46 define a second channel for receiving second fence rail 417 in a horizontal orientation and at approximately a right angle to fence rail 44. A plurality of holes 8 may be formed or disposed throughout one or more portions of fence brace member 102, wherein plurality of holes 8 are for receiving one or more fasteners to secure the fence rail therein.

Fence post brace member 102 may include at least one perpendicularly fused flap 16 forming one or more fastener holes 8 and disposed to connect fence post brace member 102 to fence post 2 by receiving one or more fasteners, such as a screw for example, through the one or more fastener holes 8.

For fence post brace member 102, the sidewalls of left fence rail flange 43 may extend rearwardly along a portion of the planar central wall to form a cutout exposing a portion of first fence rail 44 adjacent to fence post 2. In other words, in certain embodiments the rearward protruding sidewalls of left fence rail flange 43 do not extend all the way to fence post 2, but instead extend along only a portion (or subset or fraction) of first fence rail 44 so that a cutout is formed adjacent to fence post 2.

In certain embodiments as illustrated in FIG. 6 and FIG. 7, fence post brace member 102 may include at least one picket fastening slot 212 for receiving a fastener therethrough to affix a picket to fence rail 44 and/or fence rail 417 with fence brace post member 102 therebetween. The fastener may be any type of fastener capable of attaching fence post brace member 102 to fence post 2 and/or fence rail 44 and/or fence rail 417; in an ideal embodiment, the fastener is a screw. In an ideal embodiment, picket fastening slot 212 extends through the planar central wall and past a portion of the cutout (or exposed portion of first rail 44). As depicted in the various figures, an ideal embodiment includes a picket fastening slot 212 formed at left fence rail flange 43 and right fence rail flange 46.

While the present invention has been illustrated and described herein in terms of a preferred embodiment and several alternatives, it is to be understood that the devices, systems, and assemblies described herein can have a multitude of additional uses and applications. Accordingly, the invention should not be limited to just the particular description and various drawing figures contained in this specification that merely illustrate a preferred embodiment and application of the principles of the invention.

What is claimed is:

1. A fence assembly comprising:

a corner fence post having a rectangular cross-section and defining a pair of inner corner faces thereof;

a first fence rail having a rectangular cross-section;

a second fence rail having a rectangular cross-section; and a fence brace formed from a single planar piece of material, comprising:

a pair of opposing first and second fence rail flanges, each of the fence rail flanges comprising a planar central wall and a pair of upper and lower rearward-protruding side walls extending along opposing horizontal longitudinally-extending edges of the central wall, the sidewalls of the first fence rail flange defining a first channel for receiving the first fence rail therein, the sidewalls of the second fence rail flange defining a second channel for receiving the second fence rail therein, and a plurality of fastener holes disposed within the central wall and the side walls of each fence rail flange for receiving one or more fasteners to secure the fence rails therewith;

wherein the central wall of the first fence rail flange is connected to the central wall of the second fence rail flange at a right angle, and the side walls of the first fence rail flange are horizontally-aligned with the side walls of the second fence rail flange;

wherein the lower side wall of the first fence rail flange comprises a bent flap downwardly-extending from an edge thereof adjacent to a respective one of the inner corner faces of the fence post and formed from the single piece of material such to define a cutout in the lower side wall of the second fence rail flange adjacent to the other inner corner face;

wherein the upper side wall of the second fence rail flange comprises a bent flap upwardly-extending from an edge thereof adjacent to a respective one of the inner corner faces of the fence post and formed from the single piece of material such to define a cutout in the upper side wall of the first fence rail flange adjacent to the other inner corner face;

wherein the flaps each comprise one or more fastener holes for receiving one or more fasteners therethrough to secure the fence brace to the inner corner faces of the fence post; and wherein the central walls of first and second fence rail flanges each comprise a horizontal longitudinally-extending picket fastening slot for receiving a fastener therethrough to affix a picket to the first or second fence rail with the fence brace therebetween.

2. The fence assembly as recited in claim 1, wherein the fence brace is made of a material selected from the group consisting of steel, stainless steel, galvanized steel, aluminum, plastic, graphite, composite material, and any composite materials.

3. The fence assembly as recited in claim 1, further comprising at least one picket, wherein the picket is fastened to the first fence rail by passing a fastener through the picket and through one of the picket fastening slots and into the first fence rail.

4. The fence assembly as recited in claim 3, further comprising at least one additional picket, wherein the additional picket is fastened to the second fence rail by passing a fastener through the picket and through one of the picket fastening slots and into the second fence rail.

5. The fence assembly as recited in claim 1, further comprising at least one picket, wherein the picket is fastened to the first or second fence rail by passing a fastener through the picket and through one of the picket fastening slots and into the fence rail.

6. A fence assembly comprising:

a corner fence post having a rectangular cross-section and defining a pair of inner corner faces thereof;

a first fence rail that is horizontally oriented and has a rectangular cross-section;

a second fence rail that is horizontally oriented and has a rectangular cross-section; and a fence brace formed from a single planar piece of material, comprising:

a pair of opposing first and second fence rail flanges, each of the fence rail flanges comprising a planar central wall and a pair of upper and lower rearward-protruding side walls extending along opposing horizontal longitudinally-extending edges of the central wall, the sidewalls of the first fence rail flange defining a first channel for receiving the first fence rail therein, the sidewalls of the second fence rail flange defining a second channel for receiving the second fence rail therein, and a plurality of fastener holes disposed within the central wall and the side walls of each fence rail flange for receiving one or more fasteners to secure the fence rails therewith;

wherein the central wall of the first fence rail flange is connected to the central wall of the second fence rail flange at a right angle, and the side walls of the first fence rail flange are horizontally-aligned with the side walls of the second fence rail flange;

wherein the lower side wall of the first fence rail flange comprises a bent flap downwardly-extending from an edge thereof adjacent to a respective one of the inner corner faces of the fence post and formed from the single piece of material such to define a cutout in the lower side wall of the second fence rail flange adjacent to the other inner corner face;

wherein the upper side wall of the second fence rail flange comprises a bent flap upwardly-extending from an edge thereof adjacent to a respective one of the inner corner faces of the fence post and formed from the single piece of material such to define a cutout in the upper side wall of the first fence rail flange adjacent to the other inner corner face;

wherein the flaps each comprise one or more fastener holes for receiving one or more fasteners therethrough to secure the fence brace to the inner corner faces of the fence post; and wherein the central walls of first and second fence rail flanges each comprise a horizontal longitudinally-extending picket fastening slot for receiving a fastener therethrough to affix a picket to the first or second fence rail with the fence brace therebetween.

7. The fence assembly as recited in claim 6, wherein the fence brace is made of a material selected from the group consisting of steel, stainless steel, galvanized steel, aluminum, plastic, graphite, composite material, and any composite materials.

* * * * *